US007730859B2

(12) United States Patent
Tanabe et al.

(10) Patent No.: US 7,730,859 B2
(45) Date of Patent: Jun. 8, 2010

(54) VARIABLE VALVE TRAIN SYSTEM FOR INTERNAL COMBUSTION ENGINE

(75) Inventors: Mikio Tanabe, Obu (JP); Daisuke Yoshika, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/076,341

(22) Filed: Mar. 17, 2008

(65) Prior Publication Data

US 2009/0000582 A1 Jan. 1, 2009

(30) Foreign Application Priority Data

Jun. 29, 2007 (JP) ..... 2007-172029

(51) Int. Cl.
*F01L 1/34* (2006.01)

(52) U.S. Cl. ..... 123/90.16; 123/90.15

(58) Field of Classification Search ..... 123/90.15, 123/90.16, 90.17, 90.31
See application file for complete search history.

(56) References Cited

U.S. PATENT DOCUMENTS 6,536,400 B1 * 3/2003 Inumaru et al. ..... 123/196 R
2008/0308054 A1 12/2008 Kohrs et al.

FOREIGN PATENT DOCUMENTS

DE 102005030914 A1 1/2007
DE 102005059840 A1 6/2007
JP 11-44206 6/1989
JP 5-149160 6/1993
JP 2004-132515 4/2004
JP 2005-042642 A 2/2005
JP 2005-226566 A 8/2005
JP 2005-299536 A 10/2005
JP 2006-70757 A 3/2006
JP 2007-2686 A 1/2007
JP 2007-2747 A 1/2007

OTHER PUBLICATIONS

Sato, JP2007-002747, Machine Translation.*
Bosch, Kraftfahrtechnisches Taschenbuch, 21st ed., Dusseldorf: VDI publishing house, 1991.

* cited by examiner

*Primary Examiner*—Zelalem Eshete
(74) *Attorney, Agent, or Firm*—Birch, Stewart, Kolasch & Birch, LLP

(57) ABSTRACT

A variable valve train system for an internal combustion engine wherein the engagement section of a transmission mechanism is lubricated by means of an existing part for driving a variable valve actuation mechanism. Gears forming the engagement section of the transmission mechanism are arranged at a position where the engagement section is lubricated with a lubricant scattered from an endless elongate member for driving a camshaft. The transmission mechanism can therefore be lubricated without the need for additional use of a lubricant passage and its associated elements, besides the existing parts for driving the variable valve actuation mechanism.

8 Claims, 8 Drawing Sheets

VARIABLE VALVE TRAIN SYSTEM FOR INTERNAL COMBUSTION ENGINE

BACKGROUND OF THE INVENTION

1. Field of the Invention

The present invention relates to a variable valve train system for continuously controlling the valve driving output of an internal combustion engine.

2. Description of the Related Art

Reciprocating engines (internal combustion engines) mounted on motor vehicles are generally equipped with a variable valve train system attached to the cylinder head for continuously controlling the characteristics of at least intake valves, to control the exhaust gas emitted from the engine and lower the pumping loss.

Many of such variable valve train systems employ a variable valve actuation mechanism whereby the lift amount of at least the intake valves is continuously varied to adjust the amount of intake air. The variable valve actuation mechanism generally comprises the combination of a device for providing a valve driving output based on the displacement of an intake cam fitted on the camshaft, and a device for continuously varying the valve driving output (valve lift amount, valve opening/closing timing, valve open period, etc.) in accordance with the rotary displacement input from a control shaft (see, e.g., Unexamined Japanese Patent Publication No. 2005-299536).

There has also been proposed an arrangement using a driving force overcoming the valve reaction force to smoothly vary the valve driving output, wherein driving power output from a driving power source, such as an electric motor, is transmitted to the control shaft through a transmission mechanism including a speed reduction mechanism, such as a screw mechanism or a worm gear mechanism, so that the control shaft may be rotated with high torque (see Unexamined Japanese Patent Publications No. 2005-42642 and No. 2007-2686).

Where the transmission mechanism is employed, it is necessary that the engagement section between parts such as a gear and a lead screw should be lubricated with lubricating oil (lubricant) in order to permit smooth rotation of the control shaft. The engagement section between gears, in particular, is likely to be insufficiently lubricated because the gears are applied with large valve reaction force from the control shaft or, in a steady state, kept in a fixed orientation. Thus, the engagement section needs to be constantly lubricated with fresh lubricating oil.

Usually, therefore, the engine is provided with an additional oil supply system whereby part of the lubricating oil being supplied to various parts of the cylinder head is guided to the engagement section of the transmission mechanism.

To equip the engine with such an oil supply system, however, several oil passages leading to the oil gallery need to be formed in the cylinder head as well as in the parts forming the engagement section. Thus, the oil supply system is considerably complicated in structure and substantially increases costs.

SUMMARY OF THE INVENTION

An object of the present invention is therefore to provide a variable valve train system for an internal combustion engine wherein the engagement section of a transmission mechanism is lubricated by means of an existing part for driving a variable valve actuation mechanism.

To achieve the object, the present invention provides a variable valve train system for an internal combustion engine, comprising: a camshaft driven by an endless elongate member traveling while scattering a lubricant; a variable valve actuation mechanism for outputting a valve driving output based on cam displacement of the camshaft, the variable valve actuation mechanism variably controlling the valve driving output in accordance with displacement input to a control input member; and a transmission mechanism for transmitting driving power output from a driving power source to the control input member through an engagement section thereof, wherein the engagement section of the transmission mechanism is arranged at a position where the engagement section is lubricated with the lubricant scattered from the endless elongate member.

According to the present invention, as the camshaft is driven, the lubricant adhering to the endless elongate member scatters therefrom. Since the engagement section of the transmission mechanism is arranged at a position where the engagement section can receive the lubricant scattered from the endless elongate member, fresh lubricant can be continuously supplied to the engagement section without the need for an additional complicated and costly lubrication system such as oil passages. The transmission mechanism can be lubricated with the use of a simple and inexpensive arrangement. Accordingly, wear of the engagement section is restrained, improving the durability and reliability of the transmission mechanism, and also since friction of the engagement section is reduced, the response characteristic of the transmission mechanism improves. Further, the transmission mechanism and the actuator therefor can be made compact in size.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirits and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE INVENTION

Figure 1:
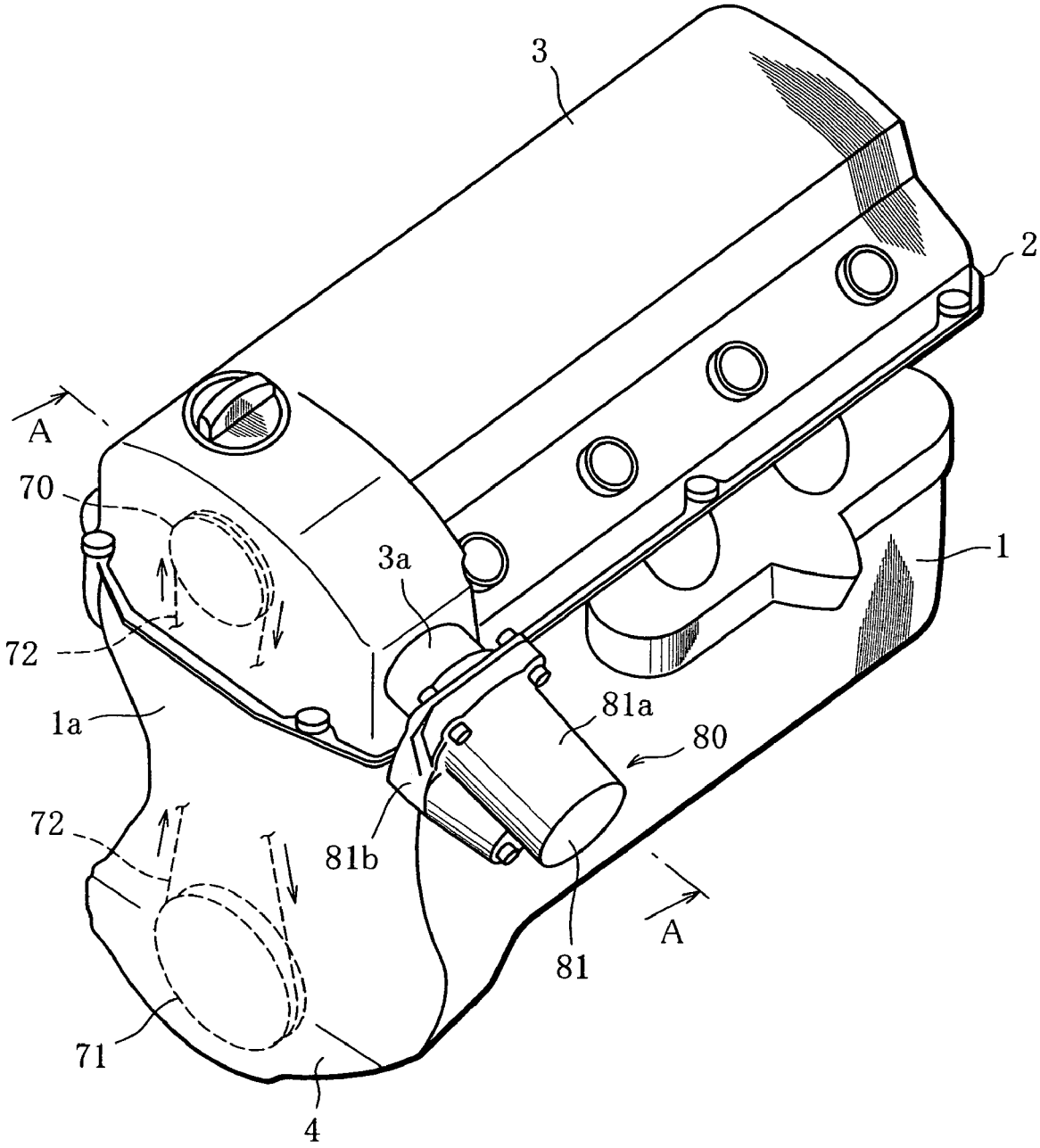
FIG. 1 is a perspective view of an in-line, four-cylinder reciprocating gasoline engine according to one embodiment of the present invention.
Figure 2:
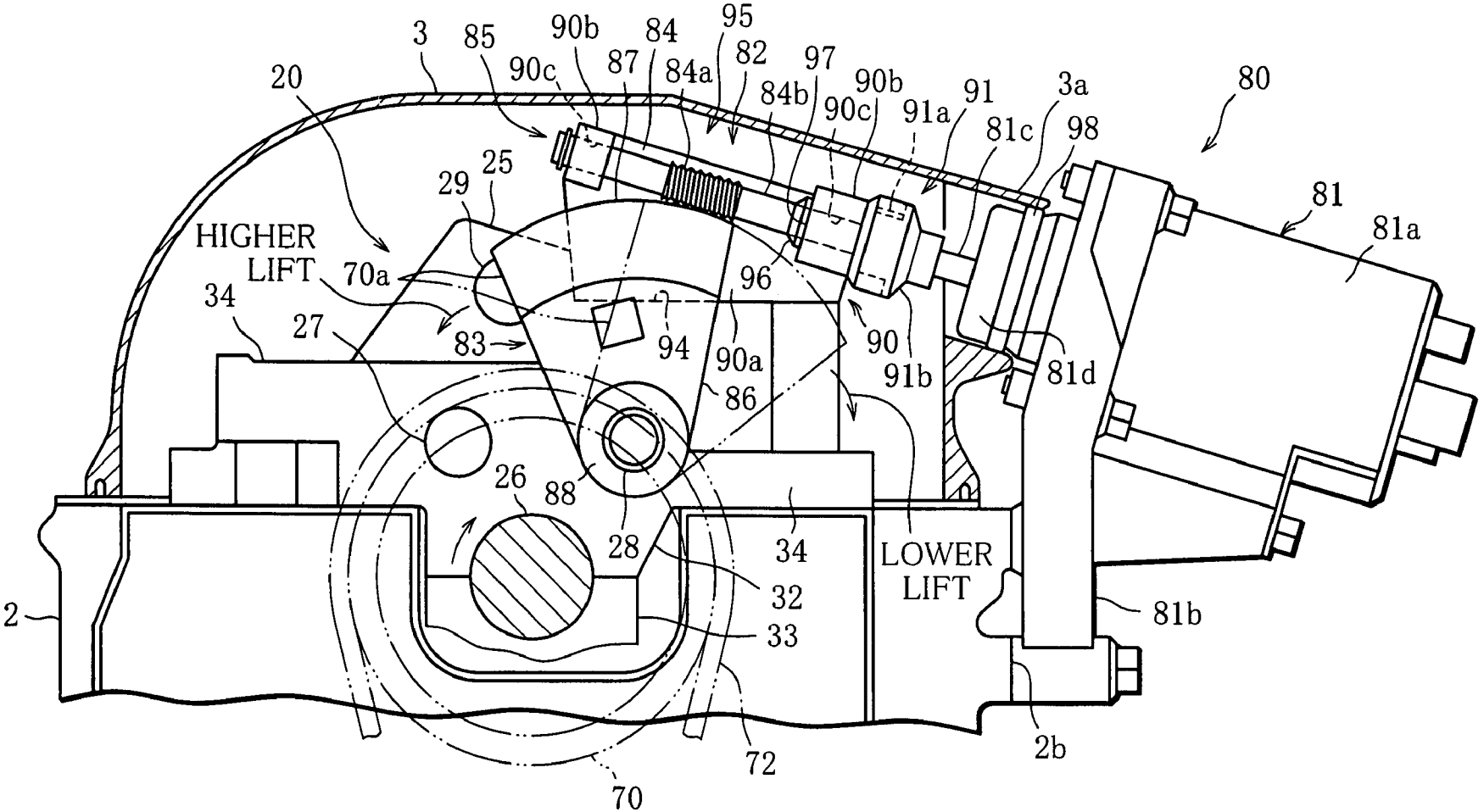
FIG. 2 is a sectional view take along line A-A in FIG. 1.
Figure 3:
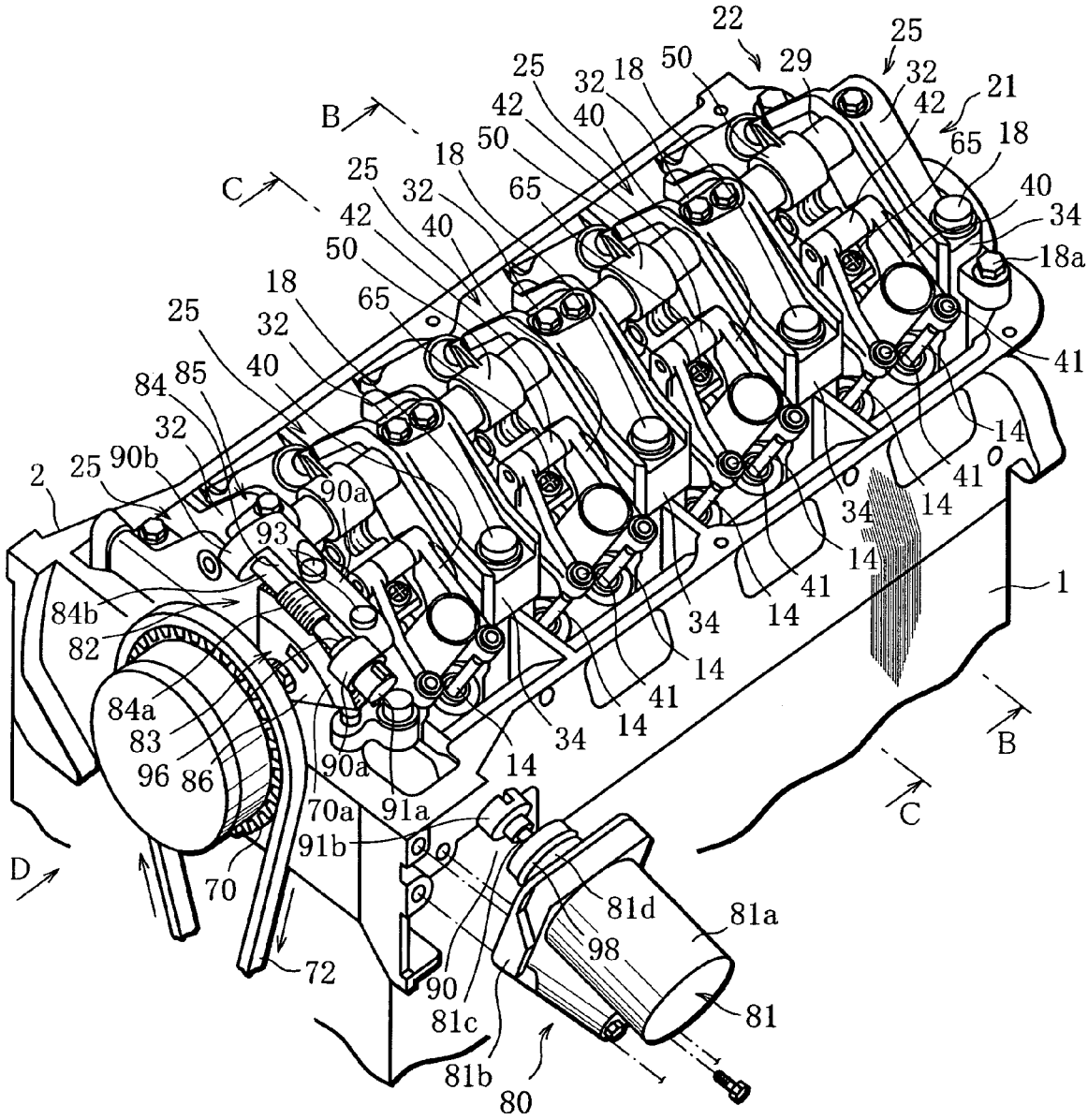
FIG. 3 is a perspective view of the engine from which a rocker cover and a timing chain cover, shown in FIG. 1, are detached.
Figure 4:
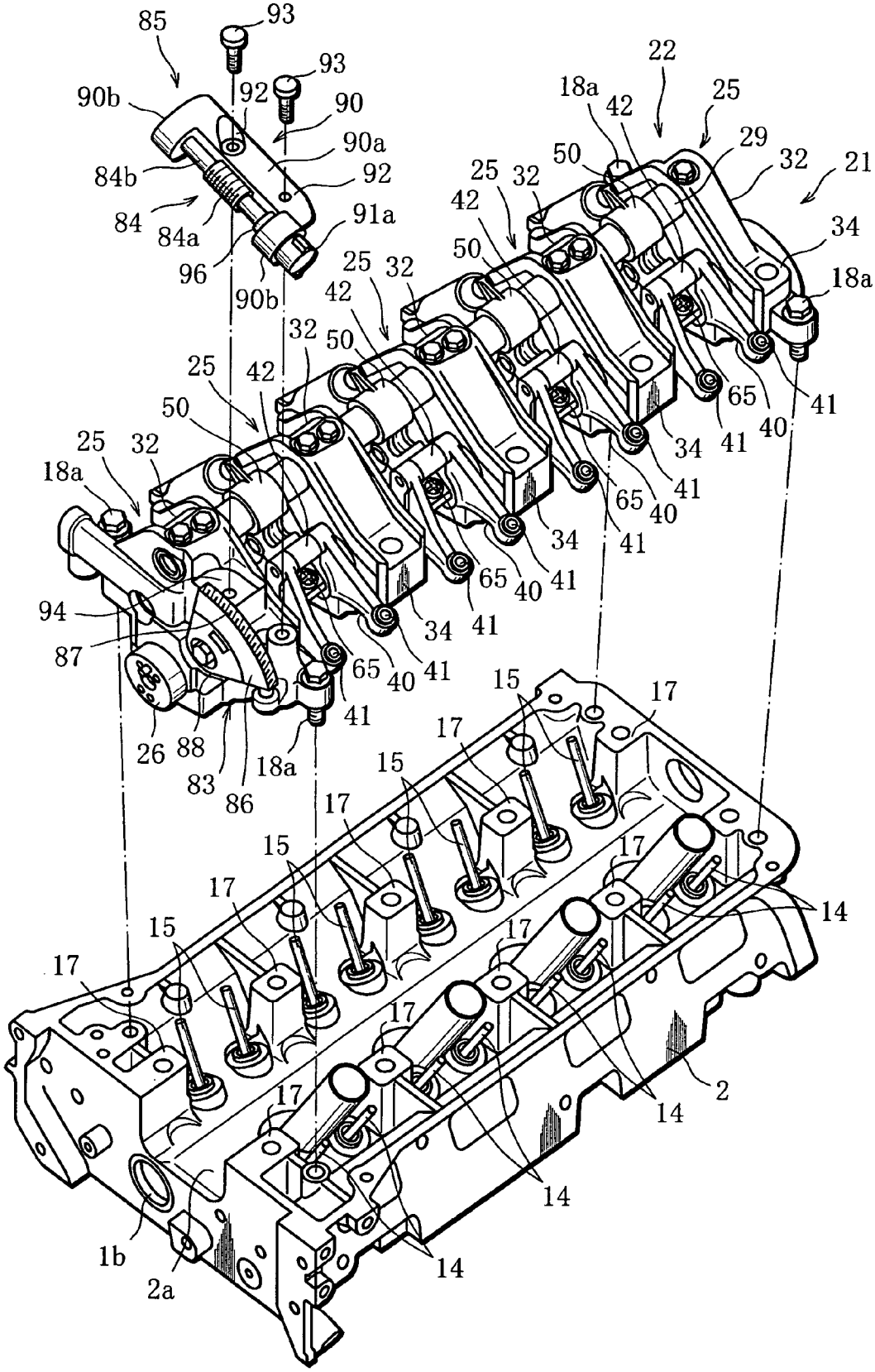
FIG. 4 is an exploded perspective view of the engine from which a variable valve train system shown in FIG. 3 is detached.
Figure 5:
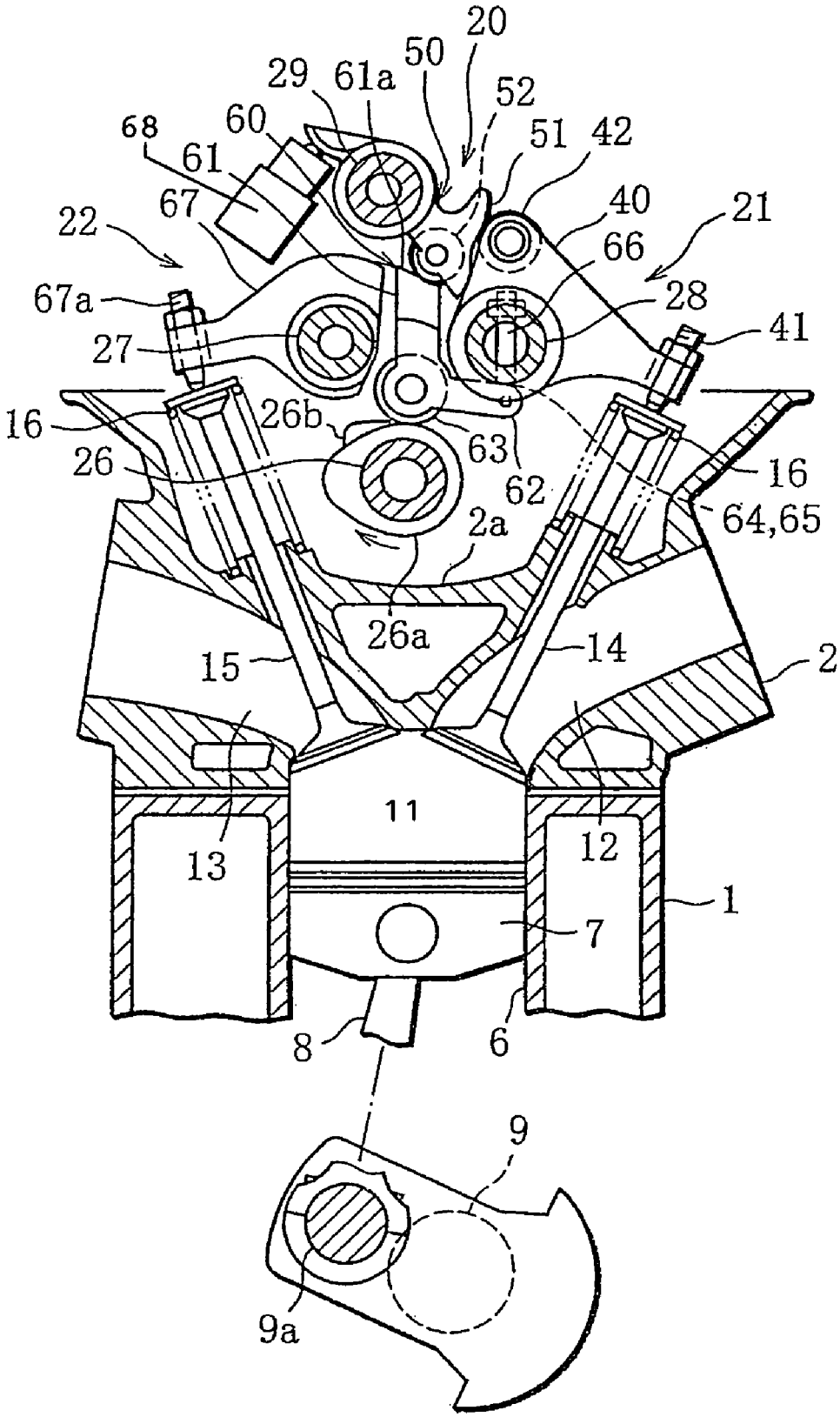
FIG. 5 is a sectional view of the variable valve train system, taken along line B-B in FIG. 3.
Figure 6:
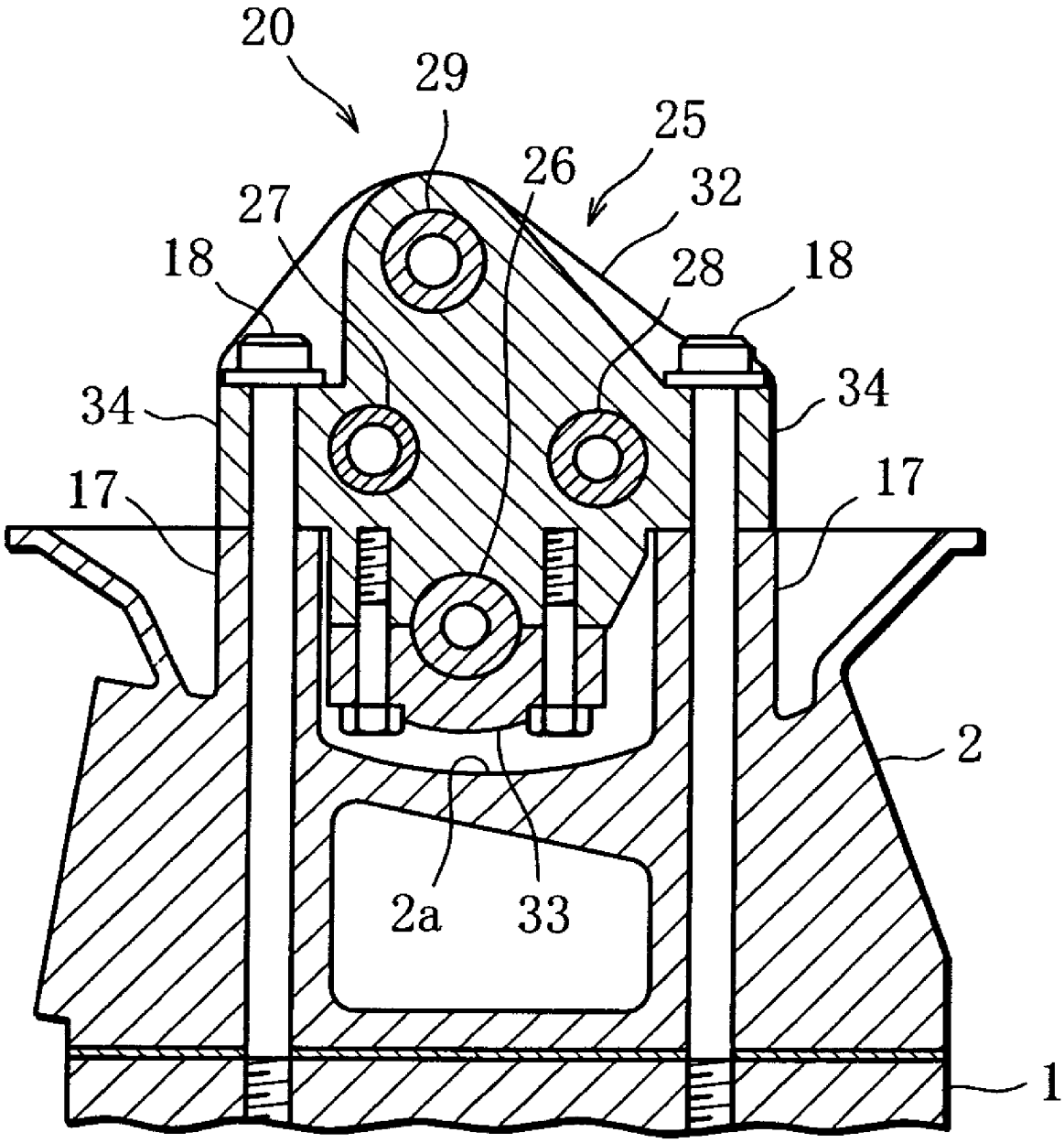
FIG. 6 is a sectional view of the variable valve train system, taken along line C-C in FIG. 3.
Figure 7:
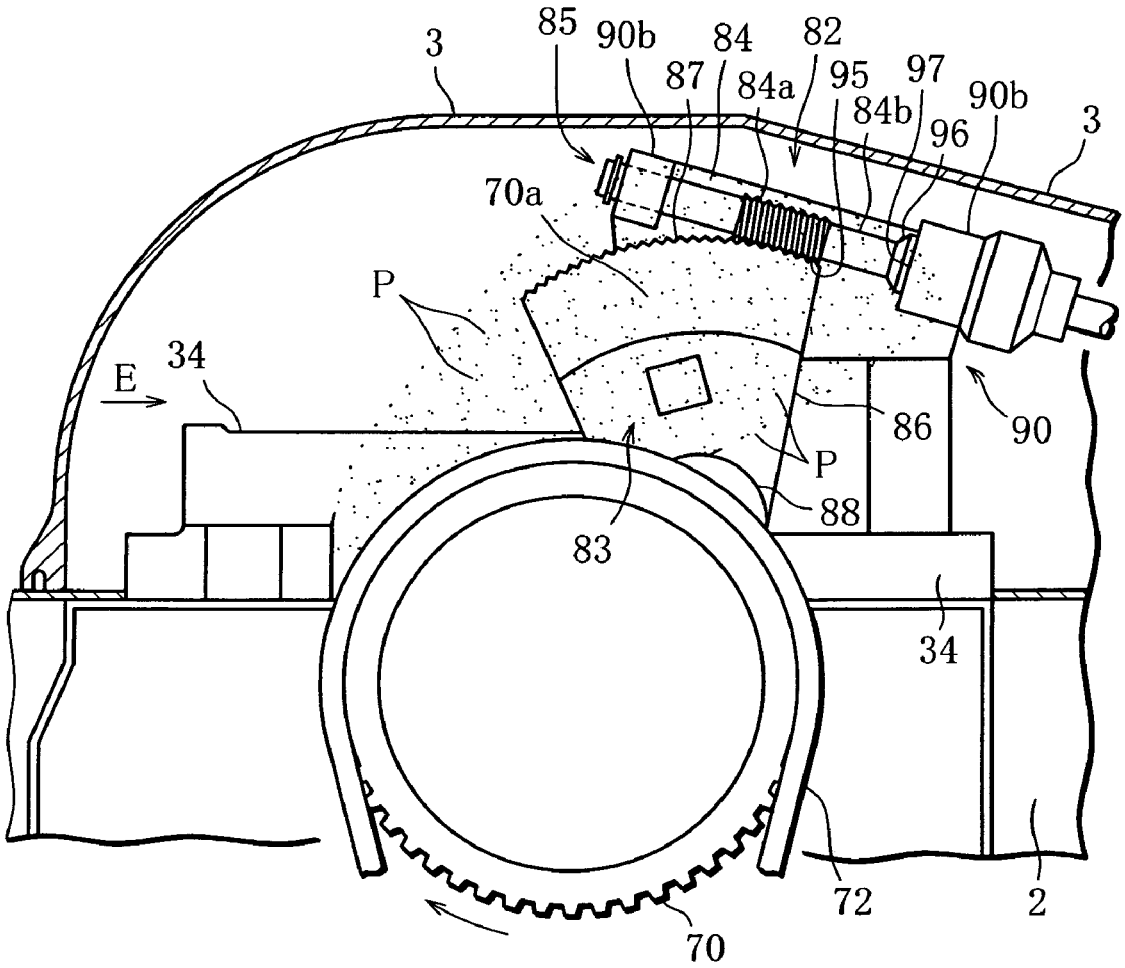
FIG. 7 shows part of the engine as viewed from the direction indicated by arrow D in FIG. 3.
Figure 8:
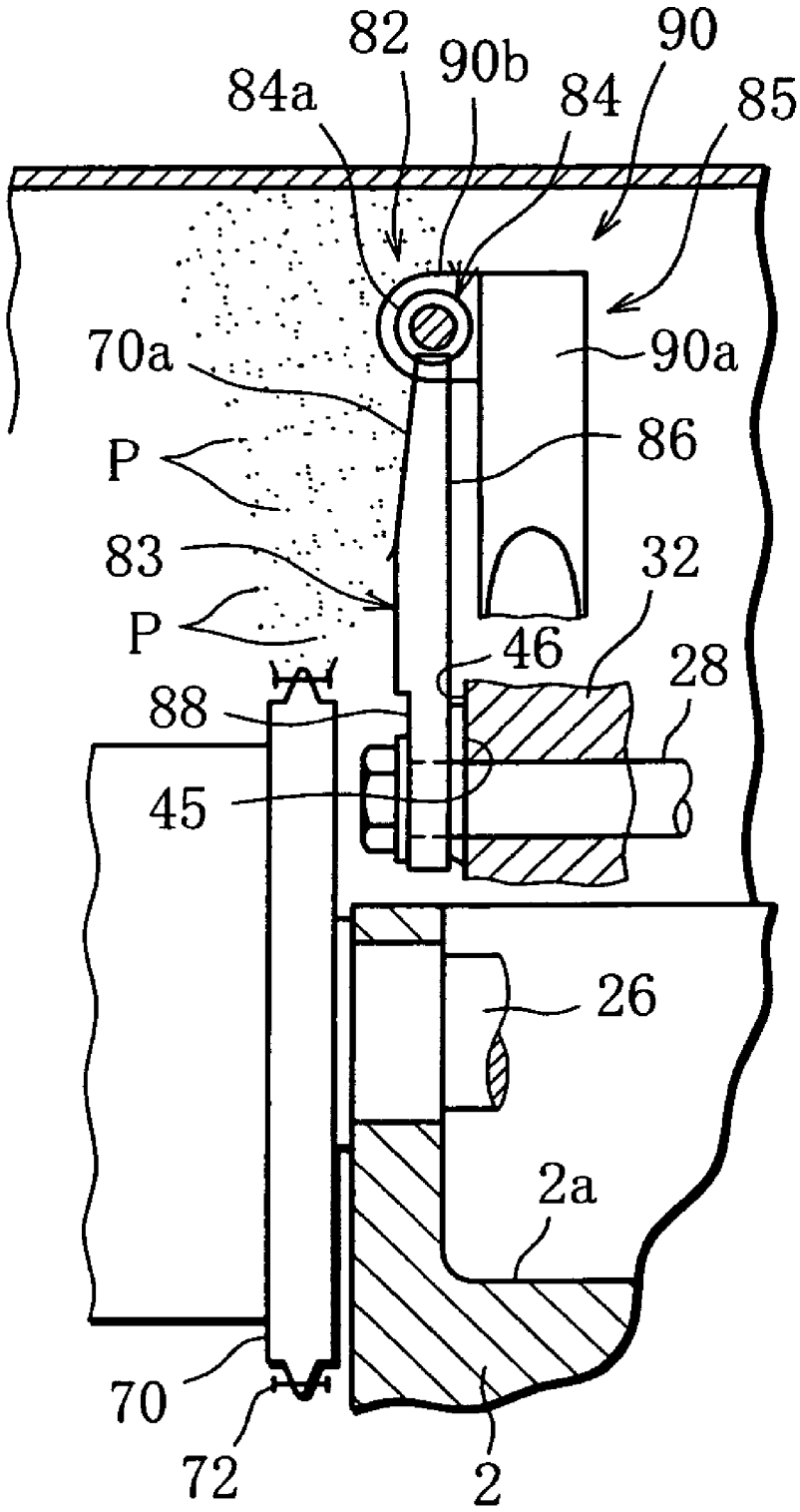
FIG. 8 is a partially sectional view of the part of the engine as viewed from the direction indicated by arrow E in FIG. 7.

An embodiment of the present invention will be hereinafter described with reference to FIGS. 1 to 8, wherein FIG. 1 is a perspective view of an internal combustion engine, for example, an in-line, four-cylinder reciprocating gasoline engine, FIG. 2 is a sectional view take along line A-A in FIG. 1, FIG. 3 is a perspective view of the engine from which a rocker cover and a timing chain cover, shown in FIG. 1, are detached, FIG. 4 is an exploded perspective view of the engine from which a variable valve train system shown in FIG. 3 is detached, FIG. 5 is a sectional view of the variable valve train system taken along line B-B in FIG. 3, FIG. 6 is a sectional view of the variable valve train system taken along line C-C in FIG. 3, and FIGS. 7 and 8 show a transmission mechanism.

In FIG. 1, reference numeral 1 denotes a cylinder block constituting an engine body; 2 denotes a cylinder head placed over the cylinder block 1; 3 denotes a rocker cover covering an upper part of the cylinder head 2; 4 denotes an oil pan formed at a lower part of the cylinder block 1; and 1*a* denotes a timing chain cover joined to a front part of the cylinder block 1.

Referring now to FIG. 5, the cylinder block 1 has four cylinders 6 (only part of which is shown) arranged adjacent to each other in the longitudinal direction of the engine. Pistons 7 are received in the respective cylinders 6 for reciprocating motion. Each piston 7 is coupled through a connecting rod 8 and a crankpin 9*a* to a crankshaft 9 extending in the longitudinal direction of the cylinder block 1 such that the reciprocating motion of the piston 7 is converted to rotary motion and then output to the crankshaft 9.

Four combustion chambers 11 associated with the respective cylinders 6, as shown in FIG. 5, are formed beneath the cylinder head 2. A pair of intake ports 12 (only one intake port is shown) open into each combustion chamber 11 from one side thereof, and a pair of exhaust ports 13 (only one exhaust port is shown) open into each combustion chamber 11 from the other side thereof. The cylinder head 2 has a recess 2*a* formed in the center of an upper surface thereof and extending in the longitudinal direction. Opposite sides of the cylinder head 2 with respect to the recess 2*a* jut out sideways. Intake valves 14 for opening and closing the respective intake ports 12 are arranged on the one side of each combustion chamber 11, and exhaust valves 15 for opening and closing the respective exhaust ports 13 are arranged on the other side of each combustion chamber 11. The intake and exhaust valves 14 and 15 are each a normally closed type and thus urged in their closing direction by a corresponding valve spring 16 (shown in FIG. 5 only).

The recess 2*a* formed in the upper surface of the cylinder head 2 is fitted with a variable valve train system 20 comprising an SOHC valve actuation mechanism, as shown in FIGS. 2 to 6. Normally, the variable valve train system 20 is covered with the rocker cover 3. The variable valve train system 20 is a unit constituted by the combination of a variable valve actuation mechanism 21 for continuously varying the characteristics of the intake valves 14 in cooperation with a camshaft 26, and an ordinary rocker arm mechanism 22 for opening and closing the exhaust valves 15 at fixed timing.

The variable valve train system 20 will be explained in more detail. In FIGS. 1 to 6, reference numeral 25 denotes retainers; 26 denotes the camshaft; 27 denotes an exhaust-side rocker shaft; 28 denotes a control shaft serving also as an intake-side rocker shaft; and 29 denotes a supporting shaft. The shafts 26 to 29 each extend in the longitudinal direction of the engine. Among these, the camshaft 26 is provided with cam groups associated with the respective cylinders, as shown in FIG. 5. Each cam group includes, for example, three cams, that is, an intake cam 26*a* and a pair of exhaust cams 26*b* (in FIG. 5, only part of which is shown) located on both sides of the intake cam 26*a*.

The retainers 25 are arranged at respective suitable positions above the cylinder head 2, for example, at the opposite ends of the cylinder row and between each pair of adjacent cylinders. As shown in FIG. 6, each retainer 25 is made up of the combination of a holder 32 and a cap 33 fixed to a lower end of the holder 32. The camshaft 26 is rotatably supported at a journal surface thereof between the lower end face of the holder 32 and the upper surface of the cap 33. The control shaft 28 is rotatably supported by an intermediate portion of the holder 32 on the intake side (one side taken in the width direction). The exhaust-side rocker shaft 27 is fixed in the intermediate portion of the holder 32 on the exhaust side (the other side taken in the width direction) opposite the control shaft 28. The supporting shaft 29 is fixed in an upper portion of the holder 32. Each holder 32 has a pair of fixing seats 34 located on both sides thereof close to the exhaust-side rocker shaft 27 and the control shaft 28, respectively, as shown in FIG. 6. The retainers and the shafts constructed in this manner form a frame mountable on the cylinder head 2.

The frame is fitted with the variable valve actuation mechanism 21 and the rocker arm mechanism 22 with respect to each cylinder. The variable valve actuation mechanism 21 comprises, as shown in FIG. 5 by way of example, the combination of a rocker arm 40, a swing cam 50, and a center rocker arm 60.

Specifically, as shown in FIGS. 3 and 4, each rocker arm 40 is constituted by a bifurcated arm member. The arm member is rotatably supported at a central portion thereof on the control shaft 28, as shown in FIG. 5, and extends to one side of the frame. The arm member has adjust screws 41 fitted into its distal ends, and a needle roller 42 provided at its proximal end and located close to the supporting shaft 29.

As seen from FIGS. 3 to 5, the swing cam 50 has one end portion rotatably supported on the supporting shaft 29, and the other end portion projecting toward the needle roller 42 of the corresponding rocker arm 40. A cam surface 51 is formed on the other end of the swing cam 50 and disposed in rolling contact with the needle roller 42. Also, a roller 52 is rotatably fitted in a lower part of the swing cam.

As shown in FIG. 5, the center rocker arm 60 is surrounded by the intake cam 26*a*, the control shaft 28, and the roller 52. The center rocker arm 60 is an L-shaped member having an arm 61 extending upward toward the roller 52 and another arm 62 extending sideways to a position right under the control shaft 28. An inclined surface 61*a* (e.g., surface sloping from the supporting shaft side down toward the control shaft) is formed on the distal end of the arm 61 and disposed in rolling contact with the roller 52 of the swing cam 50. A roller 63, which is supported by a portion of the center rocker arm 60 where the arms 61 and 62 meet, is disposed in rolling contact with the cam surface of the intake cam 26*a* so that cam displacement of the intake cam 26*a* may be transmitted, as a valve driving output, to the swing cam 50 through the arm 61. A pin 64 is relatively rotatably fitted through a hole in the distal end of the arm 62 and is also inserted into a hole 65 formed in the control shaft 28. Thus, the center rocker arm 60 is supported by the pin 64 so as to be rockable about the distal end of the arm 62. Because of this arrangement, as the control shaft 28 rotates, the center rocker arm 60 is displaced in a direction (advancing or retarding direction) across the camshaft 26 while changing the position of the rolling contact with the intake cam 26*a*.

Due to this displacement, the valve driving output from the center rocker arm 60, for example, the lift amount and opening/closing timing of the intake valves 14 are continuously varied at the same time. Specifically, the cam surface 51 includes an upper portion formed as a base circle interval corresponding to the base circle of the intake cam 26*a*, and a lower portion formed as a lift interval (corresponding to a lift region of the profile of the intake cam 26*a*) continuous with the base circle interval. Thus, as the roller 63 of the center rocker arm 60 is displaced in the advancing or retarding direction relative to the intake cam 26*a*, the orientation of the swing cam 50 changes, causing a change in the region of the cam surface 51 over which the needle roller 42 rolls. Namely, the ratio between the base circle and lift intervals brought into rolling contact with the needle roller 42 changes. The change in the ratio between the base circle and lift intervals, which accompanies a phase change in the advancing or retarding direction, is utilized to continuously vary the lift amount of the intake valves 14 from a low lift produced by the peak of the profile of the intake cam 26*a*, to a high lift produced by a longer region of the profile of the intake cam 26*a*. At the same time, the opening/closing timing of the intake valves 14 is varied such that the valve closing time changes greatly compared with the valve opening time.

A screw 66 is movably fitted into the hole 65 to allow adjustment of the amount of projection of the pin 64 (for the adjustment of the valve opening/closing timing and lift amount of the individual cylinders).

As shown in FIG. 5, each rocker arm mechanism 22 (exhaust side) has a pair of rocker arms 67 (only one of which is shown). The pair of rocker arms 67 are located on both sides of the center rocker arm 60, respectively, and rotatably supported by the exhaust-side rocker shaft 27. Each rocker arm 67 has one end portion provided with a roller (not shown), which is disposed in rolling contact with the cam surface of the corresponding exhaust cam 26*b*, and the other end portion projecting to the other side of the frame and provided with an adjust screw 67*a*.

In this manner, the camshaft 26, the variable valve actuation mechanisms 21 and the rocker arm mechanisms 22 are combined together into one unit. The fixing seats 34 of the variable valve train system 20 are placed on respective bosses 17 protruding from the bottom surface of the recess 2*a* (cylinder head 2), as shown in FIGS. 4 and 6. Then, as shown in FIGS. 3 and 6, the fixing seats 34 are fixed (fastened), together with the cylinder head 2, to the cylinder block 1 by cylinder head bolts 18. Namely, the variable valve train system 20 is fixed by the cylinder head bolts 18 having high supporting strength (the cylinder head bolts 18 are required to withstand the explosion pressure acting on the cylinder head 2 and thus have higher rigidity and mechanical strength than the other bolts). To allow the variable valve train system 20 to be firmly fixed, the cylinder head bolts 18 are located as close to the exhaust-side rocker shaft 27 or the control shaft 28 as possible. The retainers 25 situated at the opposite ends of the variable valve train system are fixed to the cylinder head 2 by using additional fixing bolts 18*a*.

Once the variable valve train system 20 is mounted as shown in FIG. 5, the adjust screws 41 of the intake-side rocker arms 40 are located on the end faces of the stems of the respective intake valves 14 fitted in the cylinder head 2, and the adjust screws 67*a* of the exhaust-side rocker arms 67 are located on the end faces of the stems of the respective exhaust valves 15 fitted in the cylinder head 2. Reference numeral 68 denotes a pusher associated with the swing cam 50. The pusher 68 presses the center rocker arm 60 through the swing cam 50 against the intake cam 26*a*.

As shown in FIG. 4, for example, the camshaft 26 has one end portion projecting frontward through a through hole 1*b* formed in an end wall of the cylinder head 2 adjacent to the recess 2*a*. The projected end portion of the camshaft 26 is fitted with a timing member, namely, a cam sprocket 70, as shown in FIGS. 1 to 3. An endless elongate member, for example, an endless timing chain 72, is passed around the cam sprocket 70 and a crank sprocket 71 fitted on the corresponding end of the crank shaft 9, so that the camshaft 26 is rotated by the crank output. The timing chain 72 is associated with a device, not shown, which is supplied with a lubricant, for example, lubricating oil from an oil gallery and sprays the oil on the traveling chain 72. The lubricating oil lubricates the sliding portions of the timing chain 72 and sprockets 70 and 71.

The front end portion of the cylinder head 2 is provided with a drive unit 80, shown in FIG. 3, for driving the control shaft 28. The drive unit 80 includes, for example, an electric motor 81 as a source of rotary power, combined with a transmission mechanism separate from the electric motor 81, or more specifically, a worm gear-type speed reduction mechanism 82. The reduction mechanism 82 includes a fan-shaped worm wheel gear 83 and a worm shaft gear 84 meshed with the gear 83. The worm shaft gear 84 and its associated elements constitute a worm shaft gear unit 85 separate from the worm wheel gear 83.

Specifically, as shown in FIGS. 3, 4, 7 and 8, the fan-shaped worm wheel gear 83 has a fan-shaped flat body 86 having numerous teeth 87 cut in an outer peripheral edge thereof, and a mounting seat 88 located radially inward of the body 86 at the center of pivotal motion. The mounting seat 88 is secured to the front end of the control shaft 28 which serves as a control input member and which projects frontward from the holder 32 (retainer 25) located at the front end of the variable valve train system, and the teeth 87 are situated above the cylinder head 2. The teeth 87 formed on the outer peripheral edge of the body 86 are located outward of the timing chain 72 passed around the cam sprocket 70, as shown in FIG. 2. Accordingly, as the timing chain 72 travels, the lubricating oil adhering to the chain 72 scatters due to the centrifugal force and is supplied to the teeth 87 and the worm shaft gear 84. Further, since the lubricating oil scattered inside the rocker cover is blocked by the gear parts, it is possible to restrain the amount of oil mist flying over to a region above the cylinders. The consumption of oil can therefore be reduced, making it unnecessary to enhance the function of an oil separator provided, for example, inside the rocker cover. A side surface of the fan-shaped body 86 located on the same side as the cam sprocket 70 may be provided with a guide for guiding the received lubricating oil to the teeth 87 formed at the outer peripheral edge of the body 86. In this case, the guide may comprise, for example, a slope 70*a* formed over the entire outside surface of the body 86 and inclining toward the outer peripheral edge. This arrangement ensures that the lubricating oil reaching the cam sprocket 70 is guided to the teeth 87, without being directed to other regions.

The worm shaft gear unit 85 has a frame 90, as shown in FIGS. 2, 4, 7 and 8. The frame 90 includes a base 90*a* extending in the width direction of the cylinder head 2, and a pair of arms 90*b* projecting from the respective opposite ends of the base 90*a* in the longitudinal direction of the cylinder head 2. A bearing surface 90*c* (shown in FIG. 2) is formed in the distal end portion of each arm 90*b*. The worm shaft gear 84 has a shaft 84*b* and a worm gear 84*a* formed at an intermediate portion of the shaft 84*b*. The shaft 84*b* is rotatably supported at opposite ends by the bearing surfaces 90*c*, so that the worm gear 84*a* is located between the bearing surfaces 90*c*. One end portion of the shaft 84*b* penetrates through the corresponding arm 90*b* and is connected with one of a male part 91*a* (corresponding to a male coupling element) and a female part 91*b* (corresponding to a female coupling element) constituting a coupling 91 provided with an Oldham coupling function. For example, the end portion of the shaft 84*b* is coupled with the male part 91*a*. Also, a mounting seat 92 is formed at each end portion of the base 90*a* to allow the frame 90 to be attached to the cylinder head 2.

As shown in FIG. 4, the mounting seats 92 are attached by fixing bolts 93 to the upper part of the holder 32 (retainer 25) located at the front end of the variable valve train system, or more specifically, to respective receiving seats 94 formed right above the control shaft 28, and therefore, the worm shaft gear unit 85 directed side-to-side relative to the cylinder head 2. When the worm shaft gear unit 85 is mounted, the worm shaft gear 84 is simultaneously meshed with the worm wheel gear 83, as shown in FIG. 2. The worm shaft gear unit 85 is mounted with its one end portion inclined toward the cylinder head 2 so that the coupling 91 may be located lower in level than an engagement section 95 between the worm shaft gear 84 and the worm wheel gear 83. Thus, a controlling rotation (rotation setting the required valve characteristics such as the valve lift amount and opening/closing timing) input from the male part 91*a* of the coupling 91 is transmitted through the engagement section 95 between the gears 83 and 84 to the control shaft 28. When the worm wheel gear 83 is rotated in a direction toward the exhaust-side rocker shaft 27, as indicated by an arrow in FIG. 2, for example, the controlling rotation for controlling the valve lift to a higher lift is transmitted to the control shaft 28. When the worm wheel gear 83 is rotated in the opposite direction toward the coupling 91, on the other hand, the controlling rotation for controlling the valve lift to a lower lift is transmitted to the control shaft 28.

The control shaft 28 and the individual parts of the variable valve actuation mechanisms 21 are combined together in a manner such that the valve reaction force (spring reaction force) applied from the variable valve actuation mechanisms 21 acts only in one rotating direction of the control shaft 28, for example, in the direction of decreasing the valve lift. Consequently, the valve reaction force acts on the worm shaft gear 84 only in one axial direction thereof. To receive the valve reaction force, a portion of the shaft 84*b* close to the coupling 91 is provided with a thrust bearing 96. Specifically, the thrust bearing 96 is in the form of a flange and located adjacent to the arm 90*b* near the coupling 91. The thrust bearing 96 is slidably borne on a thrust surface 97 (shown in FIGS. 2 and 7) formed on the arm 90*b*, whereby the thrust force deriving from the valve reaction force is prevented from being transmitted to the coupling 91.

The teeth of the worm wheel gear 83 and worm shaft gear 84 engaged with each other are directed obliquely such that the worm wheel gear 83 is urged by the valve reaction force toward the retainer 25. Because of this arrangement, the control shaft 28 is applied with thrust force only in one axial direction thereof. Also, as seen from FIG. 8, the thrust force acting (in one direction) on the control shaft 28 is borne at the front end of the control shaft 28, for example, by a bearing structure constituted by a thrust surface 45 formed at the base of the worm wheel gear 83 and a thrust bearing 46 formed on the front surface of the holder 32 (retainer 25) located at the front end of the variable valve train system.

The worm wheel gear 83 is provided further with a spring (not shown) for eliminating the backlash of the engagement section 95 between the worm wheel gear 83 and the worm shaft gear 84. The spring is arranged to exert its force on the worm wheel gear 83 in such a manner that the teeth 87 of the gear 83 are pressed against the teeth of the worm gear 84*a* of the worm shaft gear 84 only in a high valve lift region excluding a low valve lift region, for example, within the variable range over which the lift amount of the intake valves 14 is continuously varied. Thus, the backlash-eliminating spring is selectively operated depending on whether the valve lift amount is in the high valve lift region in which rattling sound is likely to be produced, or in the low valve lift region in which rattling scarcely occurs. The backlash-eliminating spring and the thrust bearing are also supplied with the lubricating oil scattered from the timing chain 72 due to the centrifugal force.

The electric motor 81, which is adapted to drive the worm shaft gear unit 85, has a body 81*a*, shown in FIGS. 2 and 3, including an ordinary rotor and stator (not shown). Specifically, the body 81*a* of the electric motor 81 has a cylindrical collar 81*d* at its distal end and a mounting bracket 81*b* formed thereon. The body 81*a* has a motor shaft 81*c* extending through the center of the collar 81*d*, and the other part of the coupling 91, that is, the female part 91*b*, is coupled to the distal end of the motor shaft 81*c*. The coupling 91 is also supplied with the lubricating oil scattered from the timing chain 72 due to the centrifugal force.

The mounting bracket 81*b* is in the form of the letter L so as to be fixed to a motor mounting surface 2*b* (FIG. 2) formed on the side portion of the cylinder head 2. Also, as shown in FIGS. 1 and 2, the collar 81*d* is so shaped that the collar can be inserted into a cylindrical insertion hole 3*a* formed in the side wall of the rocker cover 3. An annular oil seal member 98 is fitted around the outer peripheral surface of the collar 81*d* so as to protrude therefrom. The insertion hole 3*a* is located laterally outward of the male part 91*a* of the worm shaft gear unit 85 and is inclined at the same angle as the worm shaft gear 84.

Using the arrangement described above, the electric motor 81 is combined with the worm shaft gear unit 85. Specifically, as shown in FIGS. 2 and 3, the collar 81*d* is inserted into the insertion hole 3*a* while being guided thereby, and after the female part 91*b* attached to the distal end of the motor shaft 81*c* is brought into engagement with the male part 91*a* of the worm shaft gear unit 85, the mounting bracket 81*b* is bolted to the motor mounting surface 2*b* of the cylinder head 2, whereby the electric motor 81 is removably attached to the worm shaft gear unit 85. The coupling 91 has the function of absorbing the misalignment between the motor shaft 81*c* of the electric motor 81 and the worm shaft gear 84, and accordingly, the controlling rotation of the motor 81 can be properly input to the worm shaft gear unit 85.

As shown in FIG. 2, the collar 81*d* has the oil seal member 98 fitted thereon. Thus, as the collar 81*d* is inserted into the insertion hole 3*a*, only the oil seal member 98 comes into elastic contact with the inner surface of the insertion hole 3*a*, while the outer peripheral surface of the collar 81*d* remains spaced from the inner surface of the insertion hole 3*a*. Owing to this structure, the electric motor 81 is prevented from being applied not only with the thrust force but also with vibrations transmitted from the rocker cover 3.

Operation of the variable valve train system 20 constructed as above will be now described.

The camshaft 26 is driven (rotated) by the output of the crankshaft 9 transmitted thereto through the timing chain 72 traveling in the direction indicated by arrows in FIGS. 1 and 2.

As the camshaft 26 rotates, the roller 63 of the center rocker arm 60, shown in FIG. 5, is displaced by the intake cam 26*a*, so that the valve driving output is output from the center rocker arm 60. Namely, as the roller 63 is displaced by the intake cam 26*a*, the center rocker arm 60 rocks up and down about the pin 64.

The roller 52 of the swing cam 50 receives the rocking motion of the center rocker arm 60 from the inclined surface 61*a* with which the roller 52 is in rolling contact. Consequently, the swing cam 50 is repeatedly swung up and down by the inclined surface 61*a* with the roller 52 rolling on the inclined surface 61*a*. Because of the swinging motion of the swing cam 50, the cam surface 51 repeatedly moves up and down.

Since the cam surface 51 is disposed in rolling contact with the needle roller 42 of the rocker arm 40, the needle roller 42 is periodically pushed by the cam surface 51, and thus the rocker arm 40 rocks about the control shaft 28, causing the pair of intake valves 14 to open and close.

On the other hand, each exhaust-side rocker arm 67 disposed in rolling contact with the corresponding exhaust cam 26*b* is driven according to the profile of the cam 26*b*. As a result, the exhaust-side rocker arms 67 rock up and down about the exhaust-side rocker shaft 27, opening and closing the respective exhaust valves 15.

Let it be assumed that, in accordance with a command from a controller, not shown, the electric motor 81 is operated to change the valve lift amount to a higher lift. In this case, the rotation of the electric motor 81 is transmitted through the coupling 91 to the worm shaft gear 84, causing rotation of the fan-shaped worm wheel gear 83 in mesh with the worm shaft gear 84 (in the lift increasing direction shown in FIG. 2). Consequently, the rotation of the electric motor 81 is transmitted to the control shaft 28 while being reduced in speed, to rotate the control shaft 28 to an angular position corresponding to the required valve characteristics. Because of the rotation of the control shaft 28, the position of the pin 64 of the center rocker arm 60 is displaced. As a result, the roller 63 of the center rocker arm 60 is displaced relative to the intake cam 26*a* in the rotating direction of same such that the cam surface 51 of the swing cam 50 is oriented at an angle close to the vertical, as shown in FIG. 5.

The cam surface 51 oriented in this manner causes the needle roller 42 to reciprocate, or roll, within the high lift region of the cam surface 51, the high lift region being, for example, a region in which the ratio between the base circle and lift intervals is such that the base circle interval is shortest while the lift interval is longest. Consequently, the intake valves 14 are driven so that a maximum lift amount may be obtained, for example. Namely, the intake valves 14 are lifted over the entire lift interval (from the peak to the base) of the intake cam 26*a*.

Let us suppose now that the electric motor 81 is rotated in the opposite direction to change the valve lift amount to a lower height. In this case, the rotation of the electric motor 81 is transmitted through the coupling 91 to the worm shaft gear 84 to cause the fan-shaped worm wheel gear 83 to rotate in the opposite direction (in the lift decreasing direction shown in FIG. 2). Consequently, the rotation of the electric motor 81 is transmitted to the control shaft 28 while being reduced in speed, to rotate the control shaft 28 to an angular position corresponding to the required valve characteristics.

Because of the rotation of the control shaft 28, the position of the fulcrum (pin 64) of the center rocker arm 60 is displaced toward the intake cam 26*a*. As a result, the roller 63 of the center rocker arm 60 is displaced relative to the intake cam 26*a* in the direction opposite to the rotating direction of the cam 26*a*. Therefore, the position of the rolling contact between the center rocker arm 60 and the intake cam 26*a* is shifted in the advancing direction along the intake cam 26*a*. Due to the shifting of the rolling contact position, the top, or peak, of the valve lift curve shifts in the advancing direction. As the center rocker arm 60 is displaced, the inclined surface 61*a* also is displaced in the advancing direction. Because of the displacement of the center rocker arm 60, the swing cam 50 is oriented such that the cam surface 51 is directed downward. As the inclination of the cam surface 51 approaches the horizontal, the region of the cam surface 51 within which the needle roller 42 reciprocates, that is, the ratio between the base circle and lift intervals of the cam surface 51 varies such that the base circle interval becomes longer while the lift interval becomes shorter. As the ratio between the intervals varies, the operation mode of the intake valves 14 continuously changes from a mode in which the intake valves 14 are lifted over the entire lift range of the intake cam 26*a*, toward a mode in which the intake valves 14 are lifted only in a restricted region of the lift range close to the peak.

Thus, in accordance with the rotary displacement input from the control shaft 28, the valve driving output, namely, the opening/closing timing and lift amount of the intake valves 14 are continuously varied such that the valve closing timing is varied greatly while the valve opening timing is kept almost the same as that for the maximum valve lift.

During the variable control of the valve driving output, the timing chain 72 is constantly supplied with the lubricating oil to lubricate various parts. Especially, at the cam sprocket 70 where the direction of travel of the timing chain 72 changes as shown in FIGS. 7 and 8, a substantial amount of lubricating oil adhering to the timing chain 72 scatters due to the centrifugal force acting thereon.

Since the worm wheel gear 83 and the worm shaft gear 84 of the worm gear-type reduction mechanism 82 are located close to the timing chain 72, as shown in FIGS. 7 and 8, and thus are exposed to the spray P of lubricating oil, the engagement section 95 between the worm wheel gear 83 and the worm shaft gear 84 is always lubricated with the spray P of fresh lubricating oil. Although the engagement section 95 between the worm wheel gear 83 and the worm shaft gear 84 is applied with large valve reaction force (while the valve lift is high) or is kept in a fixed orientation (in a steady state), the same portion 95 can be constantly lubricated with fresh lubricating oil. Further, the spray P of fresh lubricating oil reaches a region around the engagement section 95, that is, the bearing surface 90*c* supporting the worm shaft gear 84, the thrust bearing 96 bearing the thrust force, and the coupling 91; therefore, these parts can also be sufficiently lubricated.

Consequently, the engagement section 95 of the worm gear-type reduction mechanism 82 (transmission mechanism) can be lubricated with the use of an existing part for driving the variable valve actuation mechanisms 21, namely, the timing chain 72, thus making it unnecessary to form oil passages or the like which lead to complexity of structure and increase in cost. Owing to this lubrication system, wear of the engagement section is restrained, improving the durability and reliability of the transmission mechanism, and also since friction of the engagement section is reduced, the response characteristic of the transmission mechanism improves. Further, the transmission mechanism and the actuator therefor can be made compact in size.

Especially, the engagement section 95 between the worm wheel gear 83 and the worm shaft gear 84 is located above the timing chain 72 (endless elongate member), which is passed around the camshaft 26, and is shifted forward with respect to the traveling direction of the chain 72. By just positioning the worm gear-type reduction mechanism 82 in this manner, it is possible to cause the spray P of fresh lubricating oil scattered from the timing chain 72 to reach the engagement section 95.

Moreover, since the oil spray P is received on the side surface of the worm wheel gear 83, a large amount of lubricating oil can be supplied to the engagement section 95. Namely, the worm gear-type reduction mechanism 82, which bears large valve reaction force and has a large speed reduction ratio suited for driving the control shaft 28, can be utilized to supply a large amount of fresh lubricating oil spray P to the engagement section 95, and also since the amount of oil mist scattered within the rocker cover can be restrained, the consumption of oil can be reduced.

Where the worm wheel gear 83 has the slope 70*a* (guide) formed on its side surface, the supply of lubricating oil can be further stabilized. Specifically, the spray P of lubricating oil scattered from the timing chain 72 as shown in FIGS. 7 and 8 is received on the sloped surface of the worm wheel gear 83 in large quantities, forming oil droplets. The oil droplets flow along the slope 70*a* and are positively guided to the teeth 87 of the worm wheel gear 83. Accordingly, the engagement section 95, which is applied with large valve reaction force or, in a steady state, kept in a fixed orientation, can be stably supplied with a large amount of lubricating oil.

Also, the worm gear-type reduction mechanism 82 has a separate structure constituted by the worm wheel gear 83 and the worm shaft gear unit 85 separate from the wheel gear 83. Thus, compared with an integral structure wherein the worm wheel gear 83 and the worm shaft gear 84 are combined into one unit, it is easier to assemble the worm wheel gear 83 and the worm shaft gear 84 together. Specifically, both the teeth 87 of the worm wheel gear 83 and the teeth 84*a* of the worm shaft gear 84 are usually twisted obliquely. In the case of the integral structure, troublesome work is required to engage the two gears with each other, that is, with the worm shaft gear 84 kept rotating, the shaft gear 84 must be brought into engagement with the worm wheel gear 83. The separate structure does not require such troublesome work. Namely, after the worm wheel gear 83 is mounted on the control shaft 28, the worm gear 84*a* is externally engaged with the teeth 87 of the worm wheel gear 83, and then the worm shaft gear unit 85 is fixed on the receiving seats 94 of the corresponding holder 32, whereby the worm gear-type reduction mechanism 82 can be easily mounted on the cylinder head 2. Further, since the mechanism for mounting the worm shaft gear 84 is simple, the separate structure can be simplified.

The present invention is not limited to the foregoing embodiment alone and may be modified in various ways without departing from the scope of the invention. For example, in the above embodiment, the present invention is applied to a variable valve train system for continuously varying the characteristics of intake valves, but may be applied to a variable valve train system for continuously varying the characteristics of exhaust valves. Also, in the foregoing embodiment, the variable valve train system is capable of varying the valve lift amount and the valve opening/closing timing at the same time. The present invention is also applicable to a variable valve train system adapted to vary only one of the valve lift amount and the valve opening/closing timing, for example, to a variable valve train system using a non-constant velocity coupling for varying the valve opening/closing timing.

What is claimed is:

1. A variable valve train system for an internal combustion engine, comprising:

a camshaft driven by an endless elongate member traveling while scattering a lubricant;

a variable valve actuation mechanism for outputting a valve driving output based on cam displacement of the camshaft, the variable valve actuation mechanism variably controlling the valve driving output in accordance with displacement input to a control input member; and a transmission mechanism for transmitting driving power output from a driving power source to the control input member through an engagement section thereof, wherein the engagement section of the transmission mechanism is arranged at a position closer to a body of the engine than the endless elongate member, such that the engagement section directly receives the lubricant scattered from the endless elongate member.

2. The variable valve train system according to claim 1, wherein the engagement section is located above the endless elongate member and forward with respect to a traveling direction of the endless elongate member.

3. The variable valve train system according to claim 1 or 2, wherein the endless elongate member is passed around a cam sprocket rotating together with the camshaft, and the engagement section of the transmission mechanism is located outward of a portion of the endless elongate member passed around the cam sprocket.

4. The variable valve train system according to claim 3, wherein the transmission mechanism includes a worm wheel gear mounted on the control input member and extending from a position inward of the endless elongate member to a position outward of same, and a worm shaft gear forming the engagement section in cooperation with the worm wheel gear and transmitting the driving power output from the driving power source to the worm wheel gear.

5. The variable valve train system according to claim 4, wherein the worm wheel gear is a fan-shaped member, the lubricant scattered from the endless elongate member being received on a side surface of the worm wheel gear and guided to an outer peripheral portion of the worm wheel gear.

6. The variable valve train system according to claim 4, wherein the transmission mechanism includes a fan-shaped worm wheel gear mounted on the control input member, and a worm shaft gear unit separate from the worm wheel gear and including a worm shaft gear, the worm shaft gear unit coming into engagement with the worm wheel gear when attached to a cylinder head of the engine.

7. The variable valve train system according to claim 5, wherein the transmission mechanism includes a fan-shaped worm wheel gear mounted on the control input member, and a worm shaft gear unit separate from the worm wheel gear and including a worm shaft gear, the worm shaft gear unit coming into engagement with the worm wheel gear when attached to a cylinder head of the engine.

8. The variable valve train system according to claim 1, wherein the transmission mechanism includes a wheel gear, and a surface of the wheel gear that extends in a radial direction thereof and faces the endless elongated member is provided with a guide that directs the lubricant towards the engagement section.

* * * * *